US011112156B2

(12) United States Patent
Xu et al.

(10) Patent No.: US 11,112,156 B2
(45) Date of Patent: Sep. 7, 2021

(54) REFRIGERATION APPARATUS

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Gaowei Xu, Anhui (CN); Huawei Zhang, Anhui (CN); Zengwu Qing, Anhui (CN); Rui Wang, Anhui (CN)

(73) Assignees: HEFEI HUALING CO., LTD., Anhui (CN); HEFEI MIDEA REFRIGERATOR CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 197 days.

(21) Appl. No.: 16/346,442

(22) PCT Filed: Oct. 31, 2016

(86) PCT No.: PCT/CN2016/104110

§ 371 (c)(1),
(2) Date: Apr. 30, 2019

(87) PCT Pub. No.: WO2018/076364

PCT Pub. Date: May 3, 2018

(65) Prior Publication Data

US 2020/0064039 A1 Feb. 27, 2020

(51) Int. Cl.

| | |
|---|---|
| ***F25B 49/02*** | (2006.01) |
| ***F25B 31/00*** | (2006.01) |
| ***F25B 41/22*** | (2021.01) |

(52) U.S. Cl.

CPC ..... *F25B 49/022* (2013.01); *F25B 31/00* (2013.01); *F25B 41/22* (2021.01);
(Continued)

(58) Field of Classification Search

CPC .. F25B 2500/26; F25B 49/022; F25B 43/006; F25B 41/043; F25B 45/00;
(Continued)

(56) References Cited

U.S. PATENT DOCUMENTS 5,058,389 A * 10/1991 Yasuda ..... G11B 33/144 62/99
6,845,632 B1 * 1/2005 Darling ..... F25B 41/20 62/498

(Continued)

FOREIGN PATENT DOCUMENTS

CN 2341089 Y 9/1999
CN 2401854 Y 10/2000

(Continued)

OTHER PUBLICATIONS

Inoue Machine Translation (Year: 1994).*
Mlngguo Machine Translation (Year: 2009).*
NPL Document 1 (Year: 2008).*

*Primary Examiner* — Edward F Landrum
*Assistant Examiner* — Rodrigo Royo
(74) *Attorney, Agent, or Firm* — Seed IP Law Group LLP

(57) ABSTRACT

A refrigeration apparatus, comprising: a compressor, the compressor being provided with an air exhaust opening and an air return opening; a condenser, a first end of the condenser being connected to the air exhaust opening; an evaporator, a first end of the evaporator being connected to the air return opening, a throttling element being connected in series between a second end of the evaporator and a second end of the condenser; a first control valve, the first control valve being connected in series between the evaporator and the compressor; an air suction device, a gas port of the air suction device being connected between the first control valve and the air return opening; and a control
(Continued)

6 device, the control device being connected to the compressor, the first control valve, and the air suction device.

8 Claims, 4 Drawing Sheets

(52) U.S. Cl.
CPC ..... *F25B 2400/061* (2013.01); *F25B 2500/26* (2013.01); *F25B 2600/0261* (2013.01)

(58) Field of Classification Search
CPC ..... F25B 2400/16; F25B 2313/001; F04C 15/0053; F04C 28/06; F04C 28/28; F04C 29/12; F04B 49/02; F04B 49/03; F04B 49/06–065; F04B 49/22–225; F04B 53/06; F04B 2201/0801
See application file for complete search history.

(56) References Cited

U.S. PATENT DOCUMENTS

| | | | | |
|---|---|---|---|---|
| 2011/0113797 | A1* | 5/2011 | Peyaud | F25B 49/02 62/115 |
| 2013/0025304 | A1* | 1/2013 | Dorman | F25B 49/022 62/115 |
| 2016/0370044 | A1* | 12/2016 | Danov | F25B 41/20 |

FOREIGN PATENT DOCUMENTS

| | | | | |
|---|---|---|---|---|
| CN | 101036029 | A | | 9/2007 |
| CN | 101050895 | A | | 10/2007 |
| CN | 100557338 | C | * | 11/2009 |
| CN | 105593618 | A | | 5/2016 |
| JP | 06331224 | A | * | 11/1994 |
| KR | 101270208 | B1 | | 5/2013 |

* cited by examiner

REFRIGERATION APPARATUS

FIELD

The present disclosure relates to a field of refrigeration technology, and more particularly to a refrigeration apparatus.

BACKGROUND

In the related art, a capacious refrigeration apparatus has a large refrigeration system and a high system balance pressure, resulting in difficulty in starting a compressor. Especially in a case of low voltage, a starting torque for the compressor is not sufficient, and hence the compressor tends to fail to start under low voltage. Thus, when a product containing the refrigeration apparatus of the related art is sold to an area where the voltage is slightly unstable, complaints about refrigeration failure of the refrigeration apparatus are likely to occur.

SUMMARY

The present disclosure seeks to solve at least one of the problems existing in the related art to at least some extent. Therefore, the present disclosure provides a refrigeration apparatus that can ensure a relatively low pressure at an air return opening of the compressor when the compressor is started, so as to facilitate the start of the compressor even under low voltage.

The refrigeration apparatus according to embodiments of the present disclosure includes: a compressor including an air exhaust opening and an air return opening; a condenser having a first end connected with the air exhaust opening; an evaporator having a first end connected with the air return opening, a throttling element being connected in series between a second end of the evaporator and a second end of the condenser; a first control valve having an open state and a closed state, and connected in series between the evaporator and the compressor; and an air suction device having a gas port connected between the first control valve and the air return opening, wherein when the compressor is not activated, the first control valve is closed, and the air suction device sucks a refrigerant gas between the air return opening and the first control valve, and when the compressor is activated, the first control valve is opened, and the refrigerant gas in the air suction device is discharged to the air return opening; and a control device connected with the compressor, the first control valve, and the air suction device.

For the refrigeration apparatus according to embodiments of the present disclosure, by providing the air suction device between the air return opening of the compressor and the first control valve, it can be ensured that when the compressor is activated, the air return opening of the compressor has a relatively low pressure, which is conductive to starting the compressor under low voltage conditions, thereby improving the operational reliability of the refrigeration apparatus.

According to some embodiments of the present disclosure, the air suction device includes: a first cylinder and a second cylinder spaced apart from each other; a first piston movably disposed in the first cylinder to divide the first cylinder into a first chamber and a second chamber, the first chamber being provided with the gas port, and the second chamber being in communication with the external environment; a second piston movably disposed in the second cylinder to divide the second cylinder into a third chamber and a fourth chamber, the third chamber being in communication with the external environment, and the fourth chamber being filled with a liquid to be heated, wherein a piston rod of the second piston is connected with a piston rod of the first piston to allow the first piston and the second piston to move synchronously; and a heating member disposed to the second cylinder and connected with the control device, wherein the control device controls the heating member to heat the liquid to gasify the liquid, and the air suction device sucks the refrigerant gas.

Further, the heating member is configured as an electric heating wire that is electrically connected to the control device for power supply by the control device.

Specifically, the electric heating wire has a part extending into the fourth chamber.

Further, the second cylinder has a cross sectional area smaller than a cross sectional area of the first cylinder.

Optionally, the first control valve is configured as a solenoid valve.

According to some embodiments of the present disclosure, the refrigeration apparatus further includes a second control valve connected in series between the air exhaust opening and the condenser and configured in such a way that the refrigerant gas flows unidirectionally in a direction from the air exhaust opening to the condenser.

Optionally, the second control valve is configured as a one-way valve.

Optionally, the throttling element is configured as a capillary tube.

According to some embodiments of the present disclosure, the refrigeration apparatus further includes a temperature detection device configured to detect a casing temperature of the compressor and connected with the control device, the control device controlling a working state of the air suction device based on a detection result of the temperature detection device.

Figure 1:
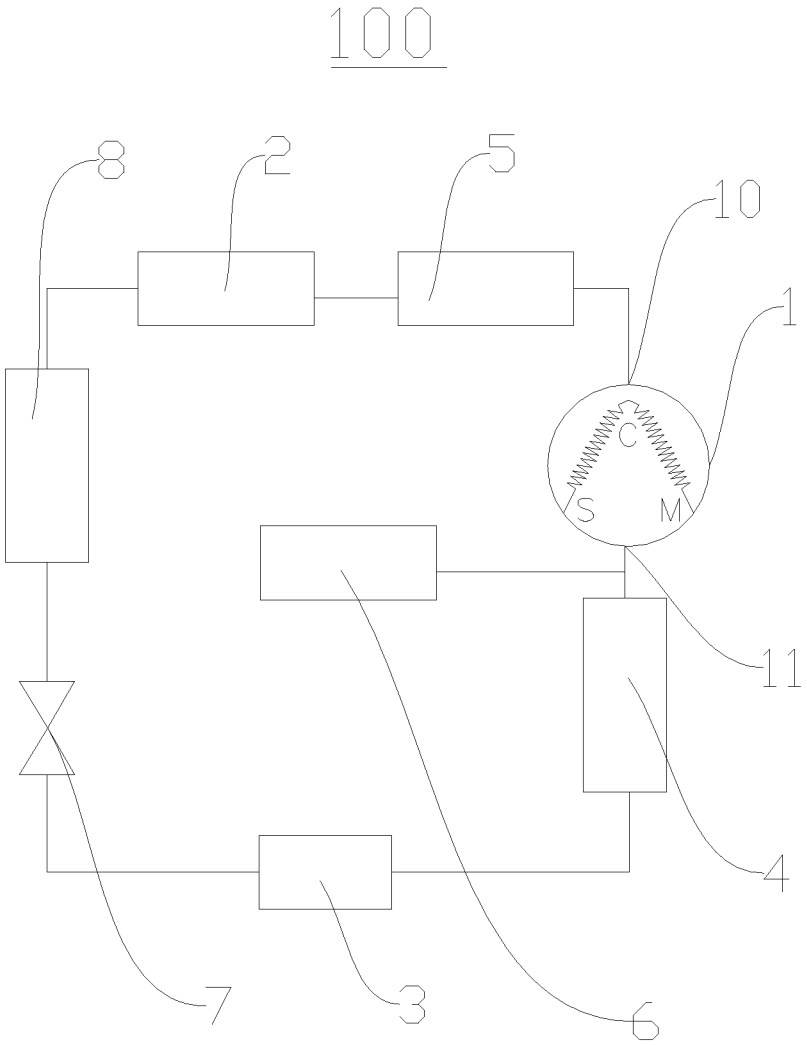
FIG. 1 illustrates a schematic view of a refrigeration apparatus according to embodiments of the present disclosure.

REFERENCE NUMERALS refrigeration apparatus 100, compressor 1, air exhaust opening 10, air return opening 11, condenser 2, evaporator 3, first control valve 4, second control valve 5, air suction device 6, first cylinder 60, first chamber 600, gas port 6000, second chamber 601, second cylinder 61, third chamber 610, fourth chamber 611, first piston 62, piston rod 620 of first piston, second piston 63, piston rod 630 of second piston, heating member 64, throttling element 7, dryer 8.

DETAILED DESCRIPTION

Embodiments of the present disclosure will be described in detail and examples of the embodiments will be illustrated in the drawings. The embodiments described herein with reference to drawings are explanatory, which are merely used to illustrate the present disclosure, but shall not be construed to limit the present disclosure.

In the specification, it is to be understood that terms such as "upper," "left," "inner," "outer" and the like should be construed to refer to the orientation or position relationship as then described or as shown in the drawings under discussion. These relative terms are for convenience and simplification of description, and do not indicate or imply that the present disclosure must have a particular orientation or be constructed and operated in a particular orientation. Thus, these relative terms should not be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, the term "a plurality of" means at least two, for example, two, three or etc., unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical connection, electrical connections, or mutual communication; may also be direct connections or indirect connections via intervening structures; may also be inner communications or mutual interaction of two elements, which can be understood by those skilled in the art according to specific situations.

Figure 2:
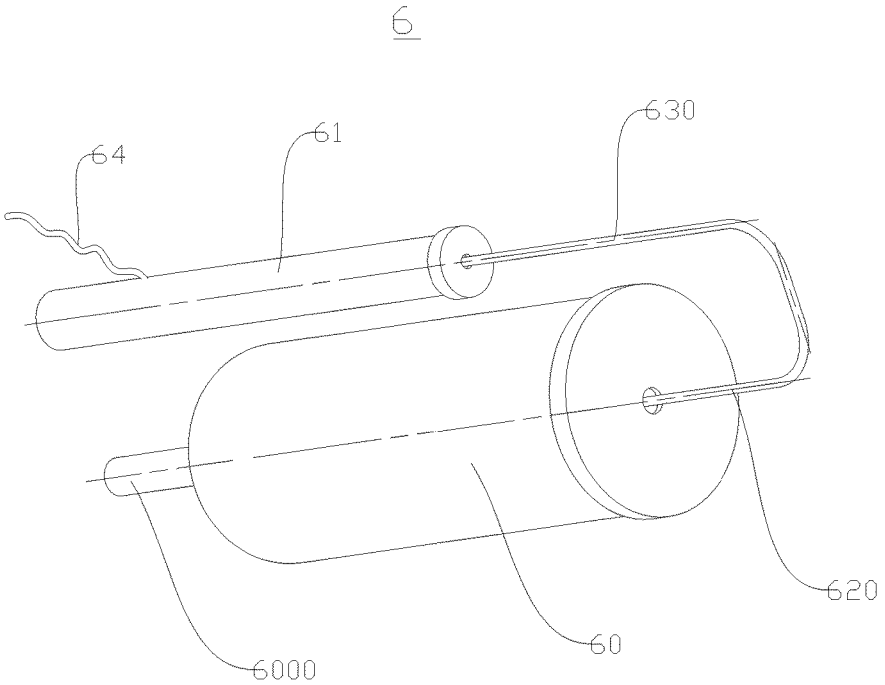
FIG. 2 illustrates a perspective view of an air suction device according to embodiments of the present disclosure.
Figure 3:
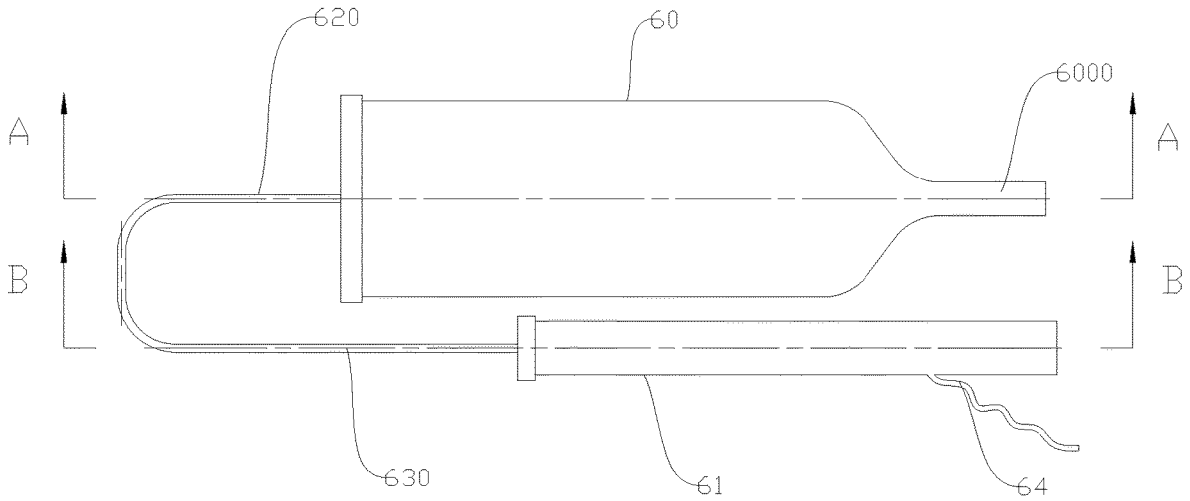
FIG. 3 illustrates a front view of an air suction device according to embodiments of the present disclosure.
Figure 4:
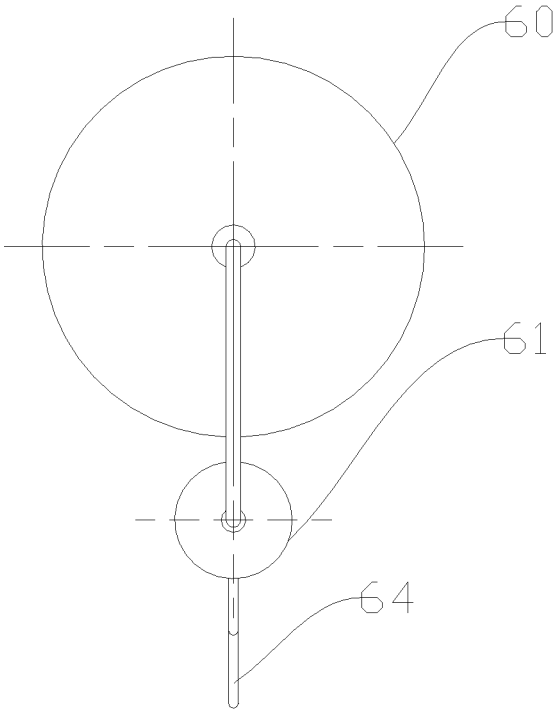
FIG. 4 illustrates a left view of an air suction device according to embodiments of the present disclosure.
Figure 5:
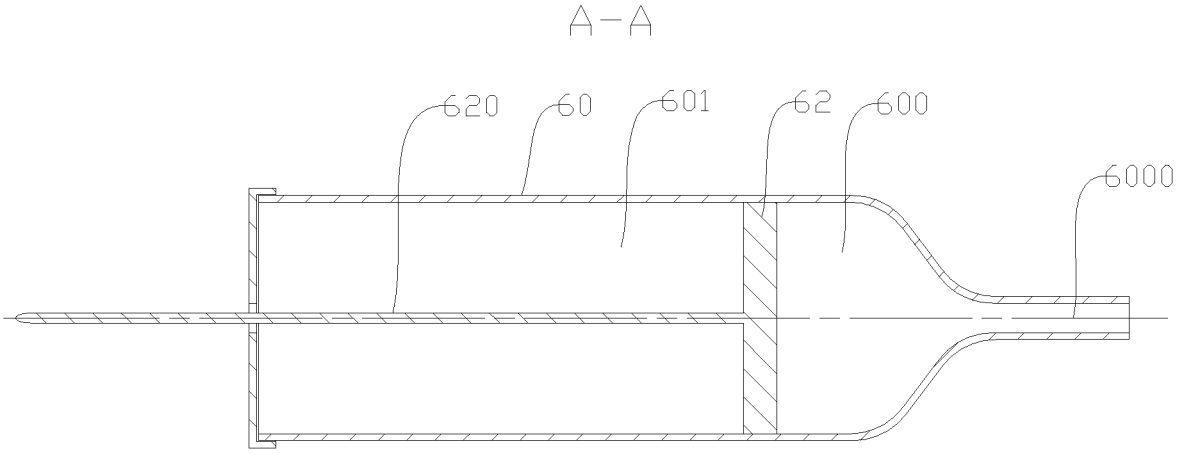
FIG. 5 is a sectional view taken along A-A in FIG. 3.
Figure 6:
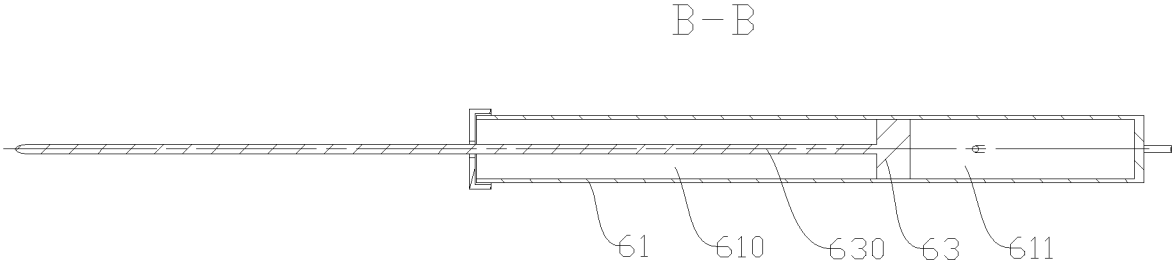
FIG. 6 is a sectional view taken along B-B in FIG. 3.

A refrigeration apparatus 100 according to embodiments of the present disclosure will be described with reference to FIGS. 1-6.

As illustrated in FIGS. 1-6, the refrigeration apparatus 100 according to embodiments of the present disclosure includes a compressor 1, a condenser 2, an evaporator 3, a first control valve 4 having an open state and a closed state, an air suction device 6, and a control device (not illustrated).

Specifically, the compressor 1 has an air exhaust opening 10 and an air return opening 11; the condenser 2 has a first end connected with the air exhaust opening 10; the evaporator 3 has a first end connected with the air return opening 11; a throttling element 7 is connected in series between a second end of the evaporator 3 and a second end of the condenser 2. The throttling element 7 can throttle the pressure of a refrigerant flowing from the condenser 2 to the evaporator 3.

The first control valve 4 is connected in series between the evaporator 3 and the compressor 1. It can be seen that the first control valve 4 can control opening and closure of a refrigerant flow path from the evaporator 3 to the air return opening 11 of the compressor 1, thereby facilitating control over the refrigerant pressure at the air return opening 11 of the compressor 1, and preventing the normal start of the compressor 1 from being affected by excessive pressure at the air return opening 11 to a certain extent.

The air suction device 6 has a gas port 6000 connected in series between the first control valve 4 and the air return opening 11. When the compressor 1 is not activated, the first control valve 4 is closed, and the air suction device 6 sucks a refrigerant gas between the air return opening 11 and the first control valve 4 to reduce the refrigerant pressure at the air return opening 11. When the compressor 1 is activated, the first control valve 4 is opened, and the refrigerant gas in the air suction device 6 is discharged to the air return opening 11 to participate in a refrigeration cycle. Thus, the refrigeration apparatus 100 can control the refrigerant pressure at the air return opening 11 of the compressor 1 by cooperation between the air suction device 6 and the first control valve 4, to enhance reliability of normal operation of the compressor 1.

The control device is connected to the compressor 1, the first control valve 4 and the air suction device 6.

For the refrigeration apparatus 100 according to embodiments of the present disclosure, by providing the air suction device 6 between the air return opening 11 of the compressor 1 and the first control valve 4, it can be ensured that when the compressor 1 is activated, the air return opening 11 of the compressor 1 has a relatively low pressure, which is conductive to starting the compressor 1 under low voltage conditions, thereby improving the operational reliability of the refrigeration apparatus 100.

According to some embodiments, the air suction device 6 includes a first cylinder 60, a second cylinder 61, a first piston 62, a second piston 63, and a heating member 64.

The first cylinder 60 is arranged spaced apart from the second cylinder 61. The first piston 62 is movably disposed in the first cylinder 60 to divide the first cylinder 60 into a first chamber 600 and a second chamber 601, the first chamber 600 is provided with the gas port 6000, and the second chamber 601 is in communication with the external environment. The second piston 63 is movably disposed in the second cylinder 61 to divide the second cylinder 61 into a third chamber 610 and a fourth chamber 611, the third chamber 610 is in communication with the external environment, and the fourth chamber 611 is filled with a liquid to be heated. A piston rod 630 of the second piston is connected with a piston rod 620 of the first piston to make the first piston 62 and the second piston 63 move synchronously. The heating member 64 is disposed and located adjacent to the second cylinder 61 and is connected with the control device, the control device controls the heating member 64 to heat and gasify the liquid in the fourth chamber 611 of the second cylinder 61 to suck the refrigerant gas into the first chamber 600 of the first cylinder 60.

Specifically, when the compressor 1 needs to be started but the external environment has a too high temperature or is too harsh for a power source, the control device controls the heating member 64 to heat the liquid in the fourth chamber 611, such that the liquid is gradually heated and gasified, thereby increasing the pressure intensity in the fourth chamber 611 to generate a relatively large pushing pressure exerted on the second piston 63, so as to push the second piston 63 to move in a direction towards the third chamber 610. Since the piston rod 630 of the second piston and the piston rod 620 of the first piston are connected to allow the synchronous movement of the first piston 62 and the second piston 63, the volume of the first chamber 600 is increased, and hence the pressure intensity in the first chamber 600 is reduced, such that the air suction device 6 sucks the refrigerant gas between the first control valve 4 and the air return opening 11 of the compressor 1 through the gas port 6000 of the first chamber 600, in which case the pressure at the air return opening 11 of the compressor 1 is lowered, and the compressor 1 can be started normally. Therefore, the reliability of the normal start of the compressor 1 can be guaranteed by the arrangement of the air suction device 6.

When the compressor 1 is activated, the first control valve 4 is opened, and the control device controls the heating member 64 to stop heating the liquid, so that the liquid in the fourth chamber 611 is cooled and liquefied, in which case the pressure intensity in the fourth chamber 611 is lowered, causing the second piston 63 to move in a direction toward the fourth chamber 611, and allowing the gas sucked into the first chamber 600 to flow back to the compressor 1 as the piston moves. This is done in such a way that the refrigeration apparatus 100 operates normally. It could be understood that the air suction device 6 does not operate when the external environment or the power source environment of the refrigeration apparatus 100 has no influence on the normal start of the compressor 1, thereby reducing the cost in use of the refrigeration apparatus 100.

Further, the heating member 64 is an electric heating wire that is electrically connected to the control device for power supply by the control device. Thus, the control of the control device over the temperature of the heating member 64 is facilitated, the temperature change rate of the heating member 64 is increased, and the starting speed of the compressor 1 of the refrigeration apparatus 100 is further raised.

A part of the electric heating wire extends into the fourth chamber 611, such that the heating member 64 can come into direct contact with the liquid in the fourth chamber 611 to increase the heating rate of the liquid heated by the heating member 64. Certainly, it could be understood that the assembling manner of the electric heating wire is not limited thereto, and the electric heating wire may also be wound around an outer peripheral wall of the fourth chamber 611.

According to some embodiments of the present disclosure, the second cylinder 61 has a cross sectional area smaller than a cross sectional area of the first cylinder 60. It is known that the piston rod 630 of the second piston is connected to the piston rod 620 of the first piston, allowing the first piston 62 and the second piston 63 to move synchronously, such that when the liquid in the fourth chamber is gasified by the heating member 64, relatively low pressure intensity is generated in the fourth chamber 611, and more refrigerant gas is sucked into the first chamber 600, thereby improving the suction efficiency of the air suction device 6, and reducing the manufacturing cost of the refrigeration apparatus 100.

Optionally, the first control valve 4 is a solenoid valve. Thus, the precision and flexibility of control of the first control valve 4 over the refrigerant can be ensured.

According to some embodiments of the present disclosure, the refrigeration apparatus 100 further includes a second control valve 5 connected in series between the air exhaust opening 10 and the condenser 2, and the second control valve 5 is configured such that the refrigerant gas flows unidirectionally in a direction from the air exhaust opening 10 to the condenser 2. Therefore, it is ensured that all the high-temperature and high-pressure refrigerant gas flowing out of the compressor 1 flows to the condenser 2, and at the same time, the refrigerant gas can be prevented from flowing from the air exhaust opening 10 to the air return opening 11 when the air suction device 6 sucks the gas, thereby improving the working efficiency of the refrigeration apparatus 100.

Optionally, the second control valve 5 is a one-way valve. Thus, the second control valve 5 has a simple structure.

Optionally, the throttling element 7 is a capillary tube. Thus, the throttling element 7 has a simple structure and low cost, and the capillary tube can control the flux and pressure intensity of the refrigerant entering the evaporator 3. It could be understood that the structure of the throttling element 7 is not limited to the capillary tube as long as it can throttle and depressurize the refrigerant entering the evaporator 3, and for example, the throttling element 7 may be an electronic expansion valve.

Optionally, the refrigeration apparatus 100 further includes a dryer 8 located between the condenser 2 and the evaporator 3. Thus, it is possible to dry and thus gasify a liquid refrigerant flowing out of the condenser, so as to avoid condensation, thereby further improving the operational reliability of the refrigeration apparatus 100.

According to some embodiments of the present disclosure, the refrigeration apparatus 100 further includes a temperature detection device configured to detect a casing temperature of the compressor 1 and connected to the control device, and the control device controls a working state of the air suction device 6 based on a detection result of the temperature detection device. It can be seen that when the temperature detection device detects that the casing temperature of the compressor 1 is higher than a casing temperature at which the compressor 1 is normally started, that is, the pressure at the air return opening 11 of the compressor 1 is so high that it affects the normal start of the compressor 1, the control devices will control the air suction device 6 to operate to suck the refrigerant gas between the air return opening 11 of the compressor 1 and the first control valve 4, thereby lowering the pressure at the air return opening 11 of the compressor 1, and enabling the compressor 1 to be started normally. The arrangement of the temperature detection device improves the working efficiency of the refrigeration apparatus 100.

The structure of the refrigeration apparatus 100 according to a specific embodiment will be described in detail with reference to FIGS. 1-6. It should be noted that the following description is only illustrative, and after reading the following technical solutions of the present disclosure, those skilled in the art can combine, replace or modify the technical solutions or some of the technical features, which also falls within the protection scope of the present disclosure.

As illustrated in FIGS. 1-6, the refrigeration apparatus 100 according to the embodiment of the present disclosure includes a compressor 1, a condenser 2, an evaporator 3, a first control valve 4 having an open state and a closed state, a second control valve 5, an air suction device 6, a control device, a temperature detection device, and a dryer 8.

The compressor 1 has an air exhaust opening 10 and an air return opening 11, and the condenser 2 has a first end connected with the air exhaust opening 10. The evaporator 3 has a first end connected with the air return opening 11, and a throttling element 7 is connected in series between a second end of the evaporator 3 and a second end of the condenser 2, in which the throttling element 7 is a capillary tube.

The first control valve 4 is a solenoid valve, and the first control valve 4 is connected in series between the evaporator 3 and the compressor 1. The second control valve 5 is a one-way valve that is connected in series between the air exhaust opening 10 and the condenser 2, and the second control valve 5 is configured to enable a refrigerant gas to flow unidirectionally in a direction from the air exhaust opening 10 to the condenser 2.

The temperature detection device is configured to detect a casing temperature of the compressor 1 and is connected to the control device. The control device controls a working state of the air suction device 6 based on a detection result of the temperature detection device.

The control device is also connected with the compressor 1, the first control valve 4 and the air suction device 6.

The air suction device 6 includes a first cylinder 60, a second cylinder 61, a first piston 62, a second piston 63, and a heating member 64.

The first cylinder 60 is arranged spaced apart from the second cylinder 61, and the second cylinder 61 has a cross sectional area smaller than a cross sectional area of the first cylinder 60.

The first piston 62 is movably disposed in the first cylinder 60 to divide the first cylinder 60 into a first chamber 600 and a second chamber 601. The first chamber 600 is provided with a gas port 6000, through which the air suction device 6 is connected between the first control valve 4 and the air return opening 11. When the compressor 1 is not activated, the first control valve 4 is closed, and the air suction device 6 sucks the refrigerant gas between the air return opening 11 and the first control valve 4; when the compressor 1 is activated, the first control valve 4 is opened, and the refrigerant gas in the air suction device 6 is discharged to the air return opening 11. The second chamber 601 is in communication with the external environment.

The second piston 63 is movably disposed in the second cylinder 61 to divide the second cylinder 61 into a third chamber 610 and a fourth chamber 611, the third chamber 610 is in communication with the external environment, and the fourth chamber 611 is filled with a liquid to be heated. A piston rod 630 of the second piston is connected with a piston rod 620 of the first piston to make the first piston 62 and the second piston 63 move synchronously.

The heating member 64 is disposed and located adjacent to the second cylinder 61 and electrically connected with the control device for power supply by the control device. The heating member 64 is an electric heating wire that has a part extending into the fourth chamber 611. The control device controls the heating member 64 to heat the liquid in order to gasify the liquid, and the air suction device 6 sucks the refrigerant gas.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Additionally, different embodiments or examples described in the specification as well as features of the various embodiments or examples may be combined by those skilled in the art without any contradiction.

Although embodiments have been shown and described, it would be appreciated by those skilled in the art that the above embodiments are explanatory, and any changes, modifications, alternatives, and variants can be made in the embodiments within the scope of the present disclosure.

What is claimed is:

1. A refrigeration apparatus, comprising:

a compressor comprising an air exhaust opening and an air return opening;

a condenser having a first end connected with the air exhaust opening;

an evaporator having a first end connected with the air return opening, a throttling element being connected in series between a second end of the evaporator and a second end of the condenser;

a first control valve having an open state and a closed state, the first control valve being connected in series between the evaporator and the compressor; and an air suction device having a gas port connected between the first control valve and the air return opening, wherein when the compressor is not activated the first control valve is closed and the air suction device sucks a refrigerant gas between the air return opening and the first control valve, and when the compressor is activated the first control valve is opened and the refrigerant gas in the air suction device is discharged to the air return opening, the air suction device including:

a first cylinder and a second cylinder spaced apart from each other;

a first piston being disposed in the first cylinder dividing the first cylinder into a first chamber and a second chamber, the first piston being moveable in the first cylinder, the first chamber being provided with the gas port, and the second chamber being in communication with the external environment;

a second piston disposed in the second cylinder dividing the second cylinder into a third chamber and a fourth chamber, the second piston being moveable in the second cylinder, the third chamber being in communication with the external environment, and the fourth chamber being filled with a liquid to be heated, wherein a piston rod of the second piston is connected with a piston rod of the first piston to allow the first piston and the second piston to move synchronously; and a heating member located adjacent to the second cylinder, the heating member heats and gasifies the liquid in the fourth chamber of the second cylinder to suck the refrigerant gas into the first chamber of the first cylinder.

2. The refrigeration apparatus according to claim 1, wherein the heating member is an electric heating wire.

3. The refrigeration apparatus according to claim 2, wherein the electric heating wire has a part extending into the fourth chamber.

4. The refrigeration apparatus according to claim 1, wherein the second cylinder has a cross sectional area smaller than a cross sectional area of the first cylinder.

5. The refrigeration apparatus according to claim 1, wherein the first control valve is configured as a solenoid valve.

6. The refrigeration apparatus according to claim 1, further comprising a second control valve connected in series between the air exhaust opening and the condenser, the second control value is configured in such a way that the refrigerant gas flows unidirectionally from the air exhaust opening to the condenser.

7. The refrigeration apparatus according to claim 6, wherein the second control valve is a one-way valve.

8. The refrigeration apparatus according to claim 1, wherein the throttling element is a capillary tube.

* * * * *